US008087552B2

(12) United States Patent
Fazekas et al.

(10) Patent No.: US 8,087,552 B2
(45) Date of Patent: Jan. 3, 2012

(54) ADAPTER FOR AEROSOL CANS

(76) Inventors: Gábor Fazekas, Budapest (HU); Hans Jürgen Werner, Warburg (DE); Rideg Mihály, Budapest (HU)

( * ) Notice: Subject to any disclaimer, the term of this patent is extended or adjusted under 35 U.S.C. 154(b) by 1167 days.

(21) Appl. No.: 10/586,833

(22) PCT Filed: Jan. 19, 2005

(86) PCT No.: PCT/EP2005/000482
§ 371 (c)(1),
(2), (4) Date: Apr. 11, 2007

(87) PCT Pub. No.: WO2005/070787
PCT Pub. Date: Aug. 4, 2005

(65) Prior Publication Data

US 2007/0181610 A1 Aug. 9, 2007

(30) Foreign Application Priority Data

Jan. 21, 2004 (DE) ..... 10 2004 003 264

(51) Int. Cl.
*B65D 83/00* (2006.01)

(52) U.S. Cl. ..... 222/402.13; 222/182; 222/402.15; 222/402.21

(58) Field of Classification Search ..... 222/402.11–402.13, 402.15, 402.24, 182, 402.1, 402.21–402.23, 222/527–530, 544, 556, 562
See application file for complete search history.

(56) References Cited

U.S. PATENT DOCUMENTS

| | | | | |
|---|---|---|---|---|
| 2,981,446 | A | 4/1961 | Campbell | |
| 4,549,674 | A | 10/1985 | Alticosalian et al. | |
| 4,978,035 | A | 12/1990 | Morane et al. | |
| 5,549,226 | A | 8/1996 | Kopp et al. | |
| 5,765,601 | A * | 6/1998 | Wells et al. | 141/38 |
| 7,017,785 | B2 * | 3/2006 | Lasserre et al. | 222/402.13 |

FOREIGN PATENT DOCUMENTS

FR 2086738 12/1971

* cited by examiner

*Primary Examiner* — J Jacyna
(74) *Attorney, Agent, or Firm* — Berliner & Associates

(57) ABSTRACT

The invention relates to an adapter (1) for aerosol cans, particularly for discharging mounting foams, said adapter comprising a receiving device (2) for the valve of the aerosol can, a conveying tube (3) for can content to be discharged which is arranged at the receiving device (2), a connection (4) on the conveying tube (3) to accommodate a trunk (16) used to enable the can content to be discharged in a well-aimed manner, a handle (5) to actuate the receiving device (2) counter to the valve of the can as well as holding means (6) for fixing the adapter to a crimping lip of the dome (15) of the can, with the receiving device (2) interacting with and having a sealing effect on the valve disk of the aerosol can and the receiving device (2) being flexibly integrated into the adapter (1).

19 Claims, 4 Drawing Sheets

ADAPTER FOR AEROSOL CANS

FIELD OF THE INVENTION

The invention relates to an adapter for aerosol cans, particularly for discharging mounting foams, said adapter comprising a receiving device for the valve of the aerosol can, a conduit for can content to be discharged which is arranged at the receiving device, a connection on the conduit to accommodate a trunk used to enable the can content to be discharged in a well-aimed manner, a handle to actuate the receiving device counter to the valve of the can as well as holding means for fixing the adapter to a crimping lip of the dome of the can.

BACKGROUND OF THE INVENTION

Aerosol cans have been in widespread use for a variety of applications. Aerosol cans are also used to accommodate mounting foam or polyurethane foam which in the building trade are indispensable materials for insulating and sealing purposes on windows and doors.

Aerosol cans of this type have a valve arranged on their upper end, the so-called can dome, via which the can content is discharged when said valve is actuated. From the valve the can contents is conveyed through an attached tube and, if applicable, a continuing trunk, on to the targeted site where it exits and is used as mounting foam. Conventional aerosol cans frequently require that the valve is actuated almost directly on the conveying tube itself which renders handling and use of the can rather uncomfortable. In particular, the can and its conveying tube must be positioned close to the point of discharge, following which the valve must be pressed which often may be quite difficult due to poor accessibility of the destination site.

To enable aerosol cans to be handled more easily the known art has proposed adapters that can be attached to the dome of the cans. Accordingly, the German patent specification DE 35 18 627 C3 discloses an apparatus comprising an adapter part to be connected with a spray gun on one end and screwed onto the aerosol can on the other end by making use of suitable connecting means. In this case, however, a separate adapter part is needed which makes can handling more complicated.

Furthermore, there are other adapters known from prior art that are provided with a thread via which they are screwed onto the aerosol can. However, the provision of such a thread always has disadvantages in that, firstly, fabrication of the adapter is comparatively intricate and expensive and, secondly, such an adapter has to be exactly adapted to the given aerosol can to make sure it fits the can correctly. Moreover, mounting foam often enters the thread spaces where it hardens and impairs the tight seating of the components due to the fact that the foam volume increases significantly so that the adapter can be removed only with difficulty and reused only after it has been thoroughly and laboriously cleaned to remove undesirable foam remnants.

In DE 43 13 319 A1 as well an adapter for mounting foam containing aerosol cans has been described. It is the objective of that invention to provide means keeping the contents of the can fresh and usable as long as possible in that the tube serving for mounting foam discharge purposes is designed so as to be capable of being folded back on itself in the form of a 'squeezing knee'. The actuating device shown there has a nozzle pointing downwards and being provided with an inner space of truncated-cone shape through which the can content shall be discharged. By actuating a handle provided on the adapter the nozzle is bent towards the valve in such manner that pressure is exerted on the valve stem causing the valve to open. To be able to actuate the valve the nozzle of the adapter is usually placed on the can in an oblique position and by pressing the handle is brought in a more perpendicular position over the can so that through the force exerted on the stem the valve can be opened.

This prior-art apparatus has the disadvantage that the force resulting from actuating the handle cannot be applied to the stem perpendicularly from above but acts on it obliquely which causes the valve to open in a non-uniform manner. Furthermore, forces exerted in order to actuate the valve always act also on the seal arranged between the nozzle and the valve.

BRIEF SUMMARY OF THE INVENTION

Proceeding from the prior-art status described hereinbefore it is thus the objective of this invention to propose an adapter by means of which aerosol cans, especially those intended for mounting foams, can be used and handled even simpler and more comfortable and which bring about a lasting and adequate sealing effect at the can, valve and adapter connection locations. A good sealing effect is also desirable in view of the fact that this is the only way of ensuring and preserving a long service life and stability of the can content.

According to the invention this objective is reached by providing an adapter for aerosol cans, particularly for discharging mounting foams, said adapter comprising a receiving device for the valve of the aerosol can, a conveying tube for can content to be discharged which is arranged at the receiving device, a connection on the conveying tube to accommodate a trunk used to enable the can content to be discharged in a well-aimed manner, a handle to actuate the receiving device counter to the valve of the can as well as holding means for fixing the adapter to a crimping lip of the dome of the can, with the receiving device interacting with and having a sealing effect on the valve disk of the aerosol can and being flexibly integrated into the adapter.

Such an adapter can be easily push-mounted onto the dome of a conventional aerosol can. The valve arranged on the top end of the aerosol can is thus positioned in a receiving device provided at the bottom side of the adapter. Connected to the hollow space of the receiving device is a conveying tube which results in the can content passing through the receiving device and entering the conveying tube when the valve is actuated. The conveying tube can then be attached to a trunk which serves to transfer the can content, preferably mounting foam, to the desired target site, with the trunk usually being a movable plastic tube which is flexible to a certain degree. Providing trunks of adequate length enables mounting foam to be conveyed also to locations which would otherwise be difficult to reach.

According to the invention the receiving device is designed such that itself and the valve it accommodates are sealed off against the environment. In this manner it is ensured that in the area of receiving device and valve there is no contact with the environment so that the mounting foam cannot harden in this area which otherwise would result in the aerosol can becoming unfit for its purpose and thus useless. Due to the fact that the receiving device is flexibly integrated in the adapter only a vertical but not a horizontal force acts on the valve when the receiving device is actuated counter to the valve of the can so that there will be no twisting or canting in the area of receiving device and valve which otherwise might impair the tightness of the apparatus. In addition, the flexible arrangement of the receiving device in the adapter results in a particularly easy and well controllable actuation of the valve by means of the handle.

The holding means by means of which the adapter is fixed to the dome of the can may be of different design. It is particularly reasonable to design the holding means in the form of a snap-fit closure so that the adapter need only be pressed against the crimping lip of the can dome causing said lip to be positioned in recesses provided for this purpose in the area of the holding means of the adapter where it snaps in place resulting in the adapter being durably and safely fixed onto the can. Moreover, such a snap-fit closure can be handled more quickly and simply than, for example, a screwed connection.

To be able to connect the adapter with the can in such a manner that both components cannot be displaced against one another the holding means should be provided with at least two retaining elements. Such retaining elements are preferably arranged on opposites sides of the adapter in order to attach the adapter to the dome of the can. Moreover, two oppositely arranged retaining elements will also make it easier for the user to secure the adapter to the dome with first the crimping lip on one side of the can dome being snapped in place and subsequently the one arranged oppositely. To strengthen the dome attachment the holding means may of course comprise more than two retaining elements.

The holding means may also be arranged so as to run circumferentially in the relevant adapter area so that they form a holding ring. Such a holding ring designed in the form of a snap-fit closure is provided with a recess over its entire circumference with which the crimping lip of the aerosol can engage. Such a holding ring serves to bring about a particularly safe connection of can and adapter.

The receiving device accommodating the valve located at the upper side of the aerosol can expediently has the form of a hollow cylinder so that a seal is provided over the entire circumference. The conveying tube is connected to the hollow cylinder which when the valve is opened results in the can content passing from the hollow cylinder of the receiving device into the conveying tube.

To bring about an adequate sealing effect due to the receiving device interacting with the valve disk the upright portion of the valve disk may be arranged such that it projects into the hollow cylinder. Such interaction may in particular be warranted by providing the receiving device with a sealing element embracing the valve disk concentrically. This sealing element causes a direct connection between receiving device and conveying tube to exist only when the valve is in open position, otherwise the hollow cylinder accommodating said valve portion has no contact with the environment and atmospheric air which means the can content will remain usable for a longer period of time. A conceivable sealing element is, for example, a concentrically arranged lip in the upright portion of the valve disk or a sealing sleeve embracing the upright portion of the valve disk.

Another aspect of the invention is that the receiving device is flexibly integrated into the adapter. In accordance with a preferred embodiment the receiving device in this case is flexibly connected with the conveying tube such that when pressing the handle the shoulder of the conveying tube is vertically displaced relative to the receiving device. Such a flexible connection of receiving device and conveying tube results in the force being exerted by the handle in vertical direction only, thus acting on the receiving device and causing the valve to open whereas horizontally exerted forces are absorbed by the flexible element arranged between receiving device and conveying tube. Expediently, the receiving device is attached to the conveying tube by means of a membrane.

Such a membrane enables the valve to be actuated quite easily without valve twisting or canting movements being experienced.

Expediently, the receiving device is rendered slidable against the valve disk with such sliding motion in relation to the valve disk causing the valve to open. The displacement of the receiving device is brought about by actuation of the handle. In this case, the receiving device is preferably flexibly connected to the holding means which enables the receiving device to be displaced relative to the valve disk while the holding means at the same time are firmly located on the crimping lip of the can dome. This connection may be effected by providing, for example, flexible webs and/or at least one element connecting to the handle.

Between handle and holding means a spring element may be provided which serves to reset the handle automatically after it has been pressed down. Furthermore, such a spring element is also considered expedient because it prevents the valve of the aerosol can to remain open too long or be inadvertently opened because the force exerted by the spring element must be overcome each time the handle is actuated. In this manner an inadvertent opening of the valve, e.g. due to the handle contacting other objects during storage or transportation which would not only cause the can to be emptied prematurely but also the surroundings to be significantly soiled by exiting mounting foam, is rather improbable.

Another improvement in this respect is a safety plate arranged between handle and holding means which is mounted between holding means and handle in such a way that the handle cannot be moved towards the holding means without the safety plate being removed first. Since the valve of the aerosol can only opens as a result of this movement any accidental opening can virtually be ruled out if such a safety plate is provided.

In accordance with another beneficial embodiment the adapter is provided with an integrated sealing plug onto which the trunk can be mounted/plugged. When the aerosol can is not in use one end of the trunk, the one opposite the end joined to the conveying tube via the connection, is mounted on the sealing plug so that the interior of the trunk is sealed off against surrounding air. In this manner substance to be discharged which may still remain inside the trunk is kept fresh for a longer time span. In particular, a hardening of the mounting foam in the trunk is avoided which would otherwise render the trunk unusable. Moreover, the plastic tube serving as trunk can be designed such that when mounting the trunk on the sealing plug a sharp bend forming a so-called 'squeezing knee' is created in the trunk which results in the sealing effect being increased. In this case the sealing plug and connection of the conveying tube are expediently arranged on the adapter relatively close to each other and on the same level so that the trunk forms into a loop, O or V when it is attached to the connection and mounted on the sealing plug. In particular, the sealing plug may be located on the handle or on the holding means. An adapter which has the trunk sealed off via a 'squeezing knee' and, if applicable, a sealing plug is known basically from DE 43 13 319 A1.

To enable the adapter to be attached to the aerosol can when stored or delivered prior to being put to use the adapter may be provided with an additional securing element. With the aid of such a securing element, which may, for example, be a snap-in type clip, the adapter is attached to the aerosol can or its cover at a predetermined place such that it is safely connected to the aerosol can during storage and transportation and, on the other hand, may be easily removed when needed. In this manner it is ensured that the adapter required for the operation of the aerosol can cannot be lost.

The adapter according to the invention has special significance for mounting foam aerosol cans; however, its use with other aerosol cans is by no means excluded.

BRIEF DESCRIPTION OF THE DRAWINGS

Further elucidation of the invention is provided through the enclosed figures, where.

DETAILED DESCRIPTION OF THE INVENTION

Figure 1:
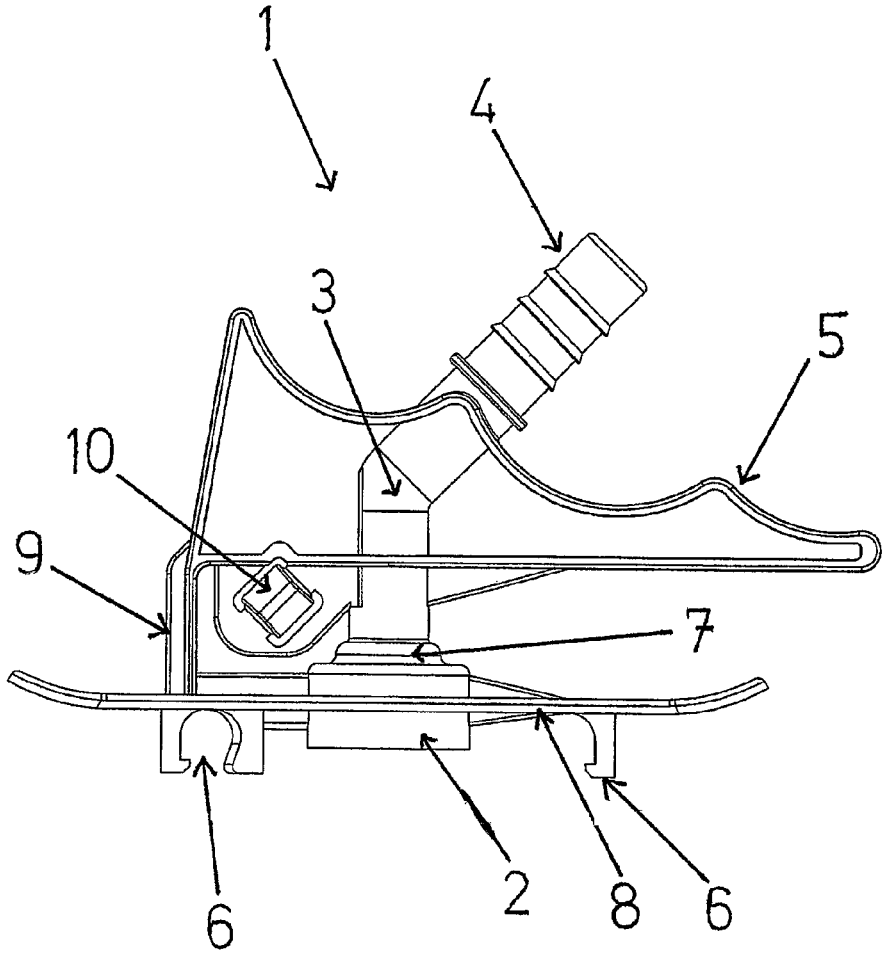
FIG. 1 shows a cross-sectional representation of an adapter according to the invention as a first embodiment.

FIG. 1 shows as a cross-sectional representation an adapter according to the invention which—in its entirety—is referred to as 1. Adapter 1 comprises a receiving device 2 accommodating the valve of the aerosol can (not shown here), a conveying tube 3 connected to receiving device 2, a handle 5 intended to operate the valve, as well as holding means 6 serving to secure adapter 1 onto a crimping lip of the can dome. As a connection between conveying tube 3 and receiving device 2 a membrane 7 is provided which ensures that the receiving device 2 is flexibly integrated into adapter 1. A connecting element 4 is attached to conveying tube 3 with said element serving to accommodate a trunk (not shown here) through which the can content is discharged and applied to the target site. To make sure the trunk can be securely mounted on connecting element 4 said element is provided with a corrugated surface.

Holding means 6 in this case consist of two separate holding elements with one holding element being provided with a receptacle accommodating a crimping lip of the can dome whereas the other element being shaped such that it engages behind the crimping lip when pressed down on it. In this manner the adapter 1 can be firmly and securely mounted onto the aerosol can.

Handle 5 is connected to the holding means 6 via fastener 9. By actuating handle 5 the conveying tube 3 is displaced vertically relative to receiving device 2 so that flexible membrane 7 is impressed to some extent causing the valve to open. The fastener 9 is of flexible design and moreover causes a restoring force to be exerted on handle 5 so that when handle 5 is not pressed down it returns to basic position. Receiving device 2 is connected to holding means 6 by means of flexible webs 8 which makes sure receiving device 2 remains movable to a certain extent whereas holding means 6 fix the adapter 1 securely to the aerosol can.

Adapter 1 also is provided with a securing element 10 designed in the form of a snap-in type clip which can be attached to the aerosol can at a predetermined place to connect the adapter 1 with the can when delivered. Moreover, such a securing element 10 also warrants that can and adapter 1 remain connected even when not in use or otherwise disassembled so that the adapter 1 cannot be lost.

Figure 2:
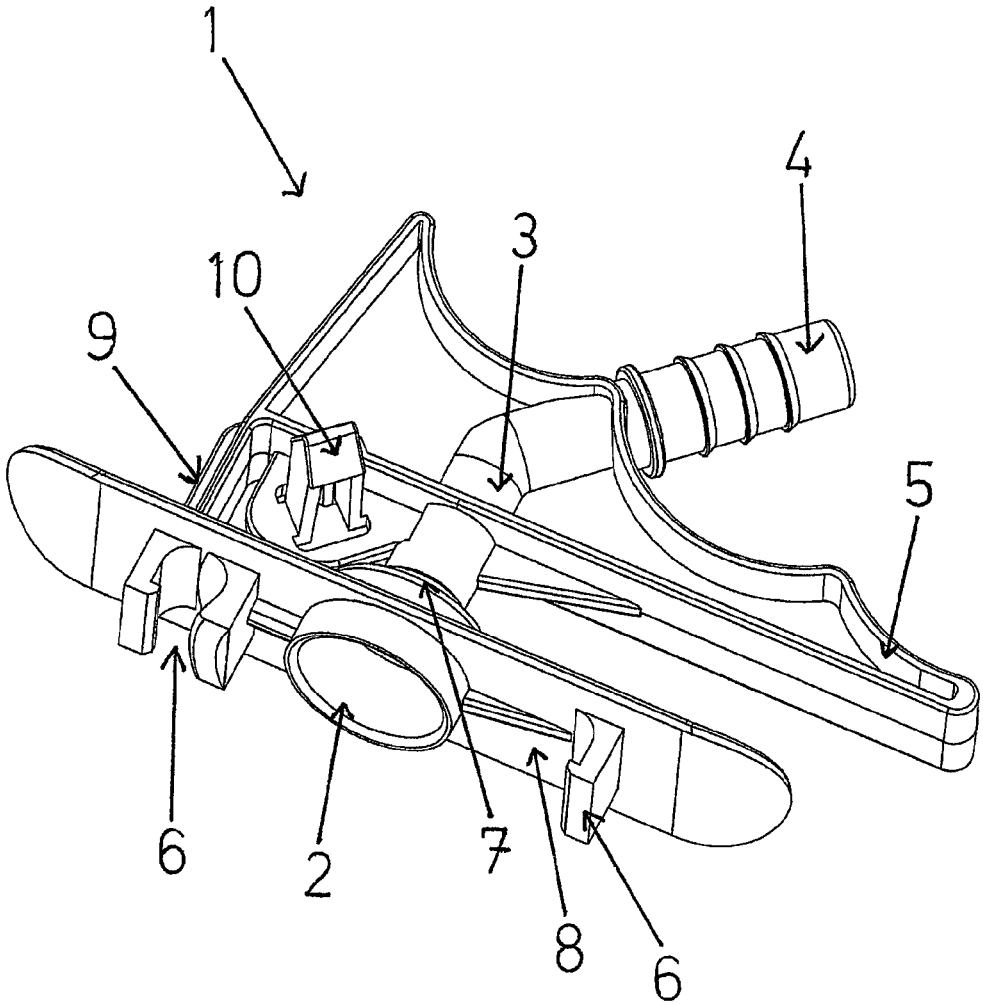
FIG. 2 is an inclined view of the adapter shown in FIG. 1 seen from below.

In FIG. 2 the adapter of FIG. 1 is shown obliquely from below so that receiving device 2 can be well seen the interior of which is shaped as a hollow cylinder.

Figure 3:
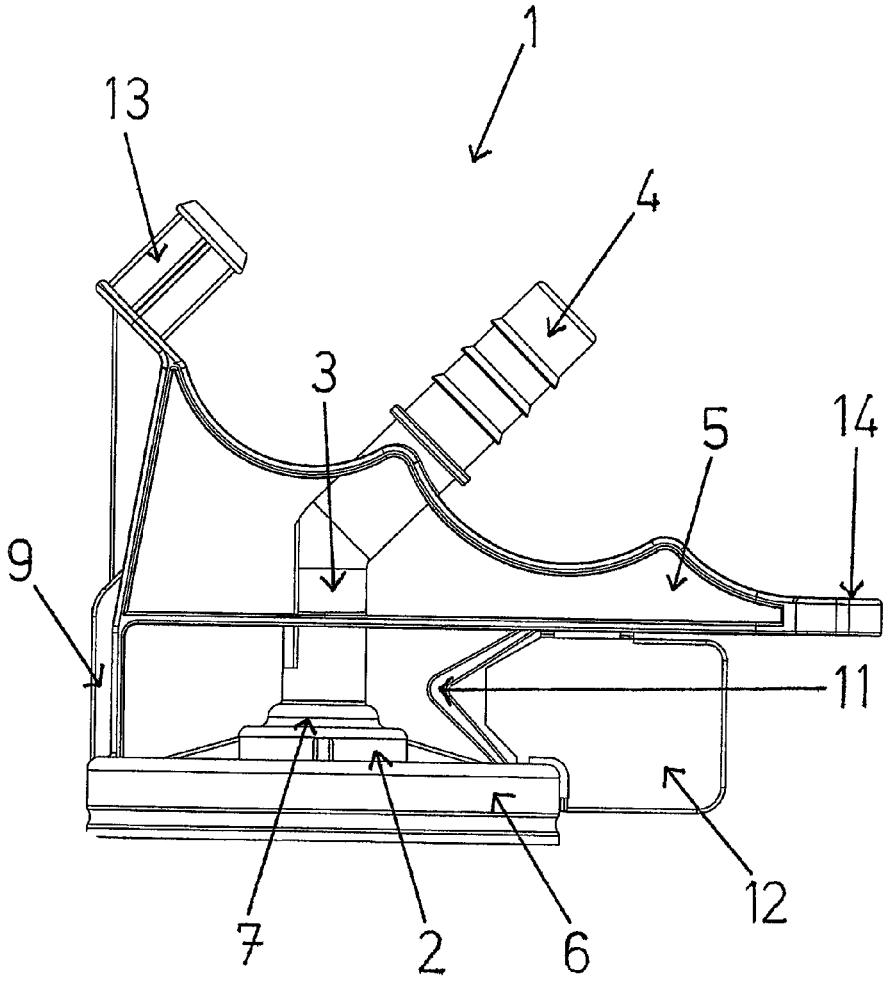
FIG. 3 is a cross-sectional representation of an adapter according to the invention as a second embodiment.

FIG. 3 shows an alternative embodiment of the adapter 1 according to the invention with said adapter basically coinciding with adapter 1 illustrated in FIG. 1. However, the adapter 1 illustrated here is of different design in that it is provided with a holding ring serving as holding means 6 and having a circumferential groove that can be pressed onto the crimping lip of the can dome. Furthermore, this adapter 1 has a spring element 11 which causes handle 5 to automatically return to its basic or original position after it has been pressed down. Moreover, to avoid an inadvertent actuation of the valve adapter 1 is provided with a safety plate 12 arranged between handle 5 and holding means 6 so that the handle cannot be pressed down when safety plate 12 is mounted. In the present case the safety plate 12 is connected to holding means 6 and handle 5 by means of several plastic linking elements which means the safety plate 12 has to be disconnected/forced out of adapter 1 before the latter can be used for the first time.

The adapter 1 shown here is also provided with a clip 14 through which the trunk can be passed when necessary. Clip 14 especially prevents the trunk from moving about freely when not in use with said trunk usually being a plastic hose. Finally, the adapter 1 also has a sealing plug 13 onto which the trunk end located opposite the one placed onto connection 4 can be mounted when the adapter is not in use in order to seal off the trunk interior against the environment.

Figure 4:
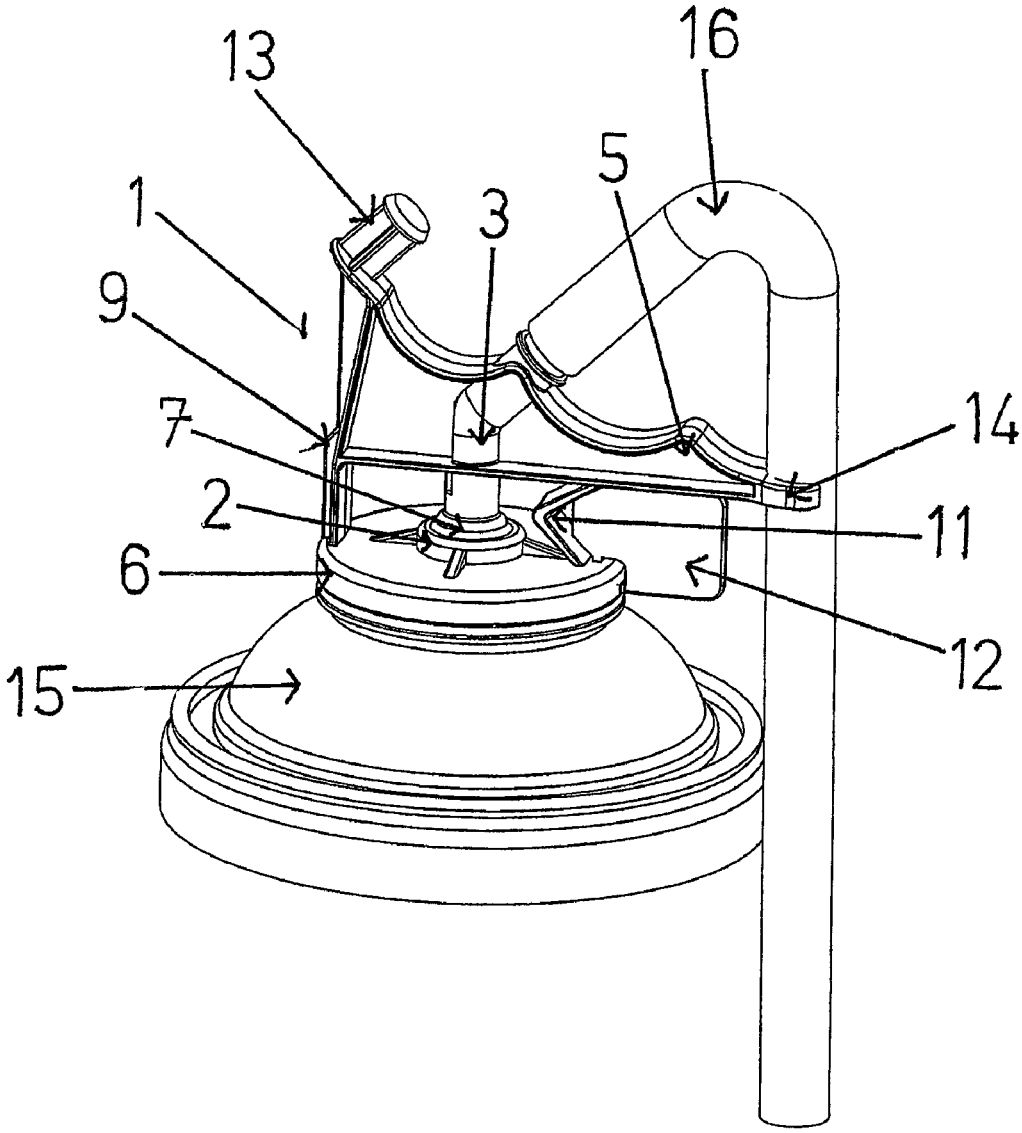
FIG. 4 illustrates the adapter shown in FIG. 3 mounted on a can dome.

FIG. 4 illustrates the adapter mounted on the can. Making use of the holding means 6 the adapter 1 is mounted on can dome 15. Furthermore, FIG. 4 shows a trunk 16 in the form of a bendable plastic hose whose one end is placed on the conveying tube with said trunk also being retained in another location by means of clip 14.

The inventive adapter (1) allows aerosol cans, especially for mounting foams, to be handled in a particularly comfortable fashion while ensuring good sealing properties particularly in the area of the connection between the adapter (1), the valve, and the dome (15) of the can, said sealing properties being particularly important for handling purposes because mounting foam hardens quickly when coming into contact with the environment so that it can no longer be used.

The invention claimed is:

1. Adapter for aerosol cans, for discharging mounting foams, said adapter comprising a receiving device (2) for the valve of the aerosol can, a conveying tube (3) for can content to be discharged which is arranged at the receiving device (2), a connection (4) on the conveying tube (3) to accommodate a trunk (16) used to enable the can content to be discharged in a well-aimed manner, a handle (5) to actuate the receiving device (2) counter to the valve of the can as well as holding means (6) for fixing the adapter to a crimping lip of the dome (15) of the can, characterized in that the receiving device (2) is flexibly integrated into the adapter (1); and wherein the receiving device (2) is flexibly connected with the conveying tube (3) by means of a membrane (7) such that when pressing the handle (5) the shoulder of the conveying tube (3) is vertically displaced relative to the receiving device (2), characterized in that the receiving device (2) is slidably supported against the valve disk, and the receiving device (2) is flexibly connected with the holding means (6), and in that the connection to the holding means (6) is achieved by means of flexible webs (8).

2. Adapter according to claim 1, characterized in that the holding means (6) are designed as a snap-fit closure.

3. Adapter according to claim 2, characterized in that the holding means (6) are provided with at least two holding elements.

4. Adapter according to claim 2, characterized in that the holding means (6) are designed as holding ring.

5. The adaptor according to claim 1, characterized in that the receiving device (2) has the shape of a hollow cylinder.

6. Adapter according to claim 5, characterized in that the receiving device (2) interacts with an upright portion of the valve disk projecting into the hollow cylinder.

7. Adapter according to claim 6, characterized in that the receiving device (2) interacts with a sealing element embracing the valve disk concentrically.

8. Adapter according to claim 7, characterized in that the sealing element is a concentrically arranged lip located in the upright portion of the valve disk.

9. Adapter according to claim 7, characterized in that the sealing element is a sealing sleeve embracing the upright portion of the valve disk.

10. The adaptor according to claim 1, characterized by a securing element (10) attaching the adaptor to an aerosol can.

11. An adapter for aerosol cans, for discharging mounting foams, said adapter comprising a receiving device (2) for the valve of the aerosol can, a conveying tube (3) for can content to be discharged which is arranged at the receiving device (2), a connection (4) on the conveying tube (3) to accommodate a trunk (16) used to enable the can content to be discharged in a well-aimed manner, a handle (5) to actuate the receiving device (2) counter to the valve of the can as well as holding means (6) for fixing the adapter to a crimping lip of the dome (15) of the can, characterized in that the receiving device (2) is flexibly integrated into the adapter (1); and wherein the receiving device (2) is flexibly connected with the conveying tube (3) by means of a membrane (7) such that when pressing the handle (5) the shoulder of the conveying tube (3) is vertically displaced relative to the receiving device (2), characterized in that the receiving device (2) is slidably supported against the valve disk, and the receiving device (2) is flexibly connected with the holding means (6), and the connection to the holding means (6) is brought about by at least one fastening element (9) connecting to the handle (5).

12. Adapter according to claim 11, characterized in that the holding means (6) are designed as a snap-fit closure.

13. Adapter according to claim 11, characterized in that the holding means (6) are provided with at least two holding elements.

14. The adaptor according to claim 11, characterized in that the receiving device (2) has the shape of a hollow cylinder.

15. Adapter according to claim 11, characterized in that the receiving device (2) interacts with an upright portion of the valve disk projecting into the hollow cylinder.

16. Adapter according to claim 11, characterized in that the receiving device (2) interacts with a sealing element embracing the valve disk concentrically.

17. Adapter according to claim 11, characterized in that the sealing element is a concentrically arranged lip located in the upright portion of the valve disk.

18. Adapter according to claim 11, characterized in that the sealing element is a sealing sleeve embracing the upright portion of the valve disk.

19. The adaptor according to claim 11, characterized by a securing element (10) attaching the adaptor to an aerosol can.

* * * * *